United States Patent [19]

Carlsen et al.

[11] Patent Number: 4,992,119

[45] Date of Patent: Feb. 12, 1991

[54] EXPLOSIVE COMPRISING A MIXTURE OF A NITRATE-OIL EXPLOSIVE AND A WATER-IN-OIL EMULSION EXPLOSIVE, AND A METHOD FOR ITS MANUFACTURE

[75] Inventors: Arne Carlsen, Skien; Erik C. Nygaard, Porsgrunn, both of Norway

[73] Assignee: Norsk Hydro a.s., Oslo, Norway

[21] Appl. No.: 500,252

[22] Filed: Mar. 27, 1990

[30] Foreign Application Priority Data

Mar. 31, 1989 [NO] Norway ..... 891365

[51] Int. Cl.[5] ..... C06B 45/00

[52] U.S. Cl. ..... 149/2; 149/46; 149/60; 149/61; 149/109.6

[58] Field of Search ..... 149/2, 109.6, 46, 60, 149/61

[56] References Cited

U.S. PATENT DOCUMENTS 3,943,820 3/1976 Persson ..... 149/19.1
4,111,727 9/1978 Clay ..... 149/2
4,181,546 1/1980 Clay ..... 149/2
4,294,633 10/1981 Clay ..... 149/2
4,736,683 4/1988 Bachman et al. ..... 149/60
4,867,813 9/1989 Young ..... 149/2

*Primary Examiner*—Stephen J. Lechert, Jr.
*Attorney, Agent, or Firm*—Wenderoth, Lind & Ponack

[57] ABSTRACT

The present invention relates to a HANFO explosive consisting of a mixture of at least one nitrate-oil explosive (ANFO-type) and at least one water-in-oil explosive, and a method for its manufacture. The oil of the ANFO part contains 0.3–7.0 weight % based on the weight of the oil component of the oilsoluble elastomer having a viscosity average molecular weight of 30,000–5 million, preferably 900,000–2.5 million. The manufacture of the HANFO explosive can be carried out by first adding an oilsoluble elastomer to the oil of the ANFO-type explosive, then mixing the oil with sodium-, ammonium- and/or calcium nitrate and then mixing this mixture together with a water-in-oil emulsion explosive. The HANFO explosive can be applied both in bulk and cartridged form.

4 Claims, No Drawings

EXPLOSIVE COMPRISING A MIXTURE OF A NITRATE-OIL EXPLOSIVE AND A WATER-IN-OIL EMULSION EXPLOSIVE, AND A METHOD FOR ITS MANUFACTURE

The present invention relates to a Heavy ANFO (HANFO) explosive comprising a mixture of a nitrate-oil explosive (ANFO-type) and a water-in-oil emulsion explosive, and a method for its manufacture.

Emulsion explosives of the water-in-oil type having hydrocarbon as its continuous phase became commercially available from the end of the 1970's. These explosives have had a great growth in recent years because in this period one has been able to solve the problem related to the stability of the explosives. Parallel to this development there has also been an increased application of the so-called Heavy ANFO (HANFO) mixtures. These consist of a mixture of an emulsion explosive and ANFO (Ammonium Nitrate Fuel Oil). Depending on the mixture ratio there is obtained mixtures having either primarily the properties of emulsion explosives or those of the ANFO explosives.

In U.S. Pat. Nos. 4,111,727, 4,181,546 and 4,294,633 there are described different variants of HANFO explosives. Usually the ANFO part comprises 20–80 weight% of the total mixture, and accordingly 80–20% of water-in-oil emulsion comprising an oxidizing salt dissolved in water and combined with an oil or a wax-oil mixture which is kept in a stable emulsion by means of an emulsifier. The explosive may also comprise hollow glass spheres, microspheres or the like for regulating the density of the mixture. Preferably ammonium nitrate (AN) is used as oxidizing salt, but also other salts like calcium nitrate, sodium nitrate, chlorates or perchlorates of ammonium, alkali or alkaline earth metals can be part of the mixture.

The problem with these known ANFO explosives is first of all related to the stability of the mixture and thereby its detonation. This is strongly influenced by the coating applied on the particle formed oxidizing salt. Further, some stabilizers usually added to the oxidizing salt will have a negative effect on the stability of the mixture. Among such known stabilizers the following can be mentioned: borates, ammonium sulphate and ammonium phosphate.

Ammonium nitrate which can be present in different forms, is usually coated with different types of coating for reducing the caking tendency during storage. Actual forms for ammonium nitrate are:

porous prills (ANFO-grade or explosive grade)
dense prills (Fertilizer Grade)
dense or porous granules
dense or porous crystalline ammonium nitrate Regardless of the type of ammonium nitrate used it is of great importance that it is a free-flowing pulverant when it shall be mixed with the emulsion explosive. Typical coatings are organic compounds containing amines, sulphonates or salts of fatty acids, different inorganic pulverants (silicates) or combinations of these. Common for these coatings is that they prevent caking of the ammonium nitrate particles during storage.

The ANFO part can consist of a mixture of nitrates, for instance ammonium nitrate, sodium nitrate or calcium nitrate. For this purpose the calcium nitrate is defined as pure calcium nitrate $Ca(NO_3)_2$ and technical calcium nitrate which contains 79% $Ca(NO_3)_2$, 6% AN and 15% water of crystallization.

When oil is added to ammonium nitrate for formation of ANFO a thereupon mixed with emulsion explosive, it has been found that the coating applied on the ammonium nitrate has a negative effect on the stability of the HANFO. There are great variations depending on the type of coating, but a common effect for all these is that they to a larger or lesser extent negatively influence the storage stability of the mixture. The result is that the HANFO mixture loses its smooth consistency and will harden. This means that the emulsion is broken down and that the nitrate solution crystallizes. The end result is a very hard mixture which no longer is waterproof, and its detonating properties are substantially reduced.

The problem which the above mentioned coating causes for such HANFO explosives can not be avoided by using non-coated ammonium nitrate because there will always be a need for storing ammonium nitrate for at least so long that there is a danger of caking together of the nitrate. The problem can not be solved by applying other types of oxidizing salts as also these to a great extent will have similar coatings.

The object of the present invention was to arrive at a HANFO explosive without the above mentioned stability problems and where nitrate salts could be used independent of their anticaking coatings or stabilizers.

A series of tests were started to find out whether there was any coating which did not have such negative influence on the HANFO explosive or very small negative effect such that it could be applied. These investigations did not give the desired result. Further one did not want to be restricted to use a most specific coating, but would be free to apply nitrate from different suppliers. It was then investigated whether these coatings could be neutralized by adding further coatings to the nitrate and thereby neutralize the effect of the original coating. There seemed to be some coatings of the so-called slow-release type which could have a positive effect, but this resulted in unacceptably high costs. The inventors then tried to add different additives to the oil which the ammonium nitrate should be mixed with in order to neutralize the negative effect of the coatings. The only additive which seemed to have a positive effect was some high polymeric compounds, and especially elastomers. By adding small amounts of a high molecular isobutylene to the oil before it was mixed with the ammonium nitrate it was found that the above problem was substantially reduced. The emulsion of the mixture was not broken down and there was no crystallization occurring in the ANFO explosive during storage. The same technique applied on sodium nitrate and calcium nitrate gave corresponding effect. A possible explanation on what was happening could be that the elastomer, because of its high molecular weight, would not be absorbed to a large degree in the pores and cracks of the nitrate particles, but mainly be left on the surface and thereby form a layer on the outside of the already present coating components. As the continuous phase of the emulsion is hydrocarbons, it will be this which first gets in contact with the coated nitrate particles. Further tests showed that the emulsions were compatible with different types of elastomers contrary to the previously mentioned conventional coating compounds.

By adding elastomer to the oil one has in fact been able to coat the nitrate particles without doing it in such an expensive way as the preliminary investigations required. The result of these last investigations were so promising that they were followed up by more comprehensive investigations, and the results of these are given in the tables in connection with the examples.

First it was investigated whether application of the elastomer containing coating on the AN particles was sufficient for obtaining stable HANFO. From EP applications No. 88 121 145.2 (Norwegian application No. 875302) it is known to coat nitrate, especially calcium nitrate, with a coating containing elastomers. This coating is primarily applied for preventing dust formation. Such a coating seemed to have positive effect, however storage tests showed that also by using this elastomer containing coating the HANFO explosive hardened after a few days. The amount of elastomer was possibly too low. AN can not for security reasons contain more than 0.2% hydrocarbon, calculated as carbon, and coated AN particles according to the above application will not solve the stability problems of HANFO explosives.

The elastomers described here comprise a large group of chemical compounds having in common that the molecular weights and thereby the chain length are very large. Typical examples of applicable elastomers are polyisobutylenes which can have a viscosity average molecular weight of 30,000–5 million. Another group of suitable elastomers are the thermoplastic ones. These differ from the first mentioned group by having a viscosity which is strongly temperature dependent, and above a certain temperature such compounds will therefore have a much lower viscosity than below this temperature. The same will also be the case for mixtures of oil and such elastomers. Typical examples of such thermoplastic elastomers are Cariflex from Shell.

Elastomers which will be suitable for the present invention must first of all be oil-soluble and be visco-elastic in the oil. It should further have a viscosity average molecular weight of 30,000–5 million and preferably 900,000–2.5 million. Especially suitable elastomers in addition to polyisobutylenes can be styrene-butadiene-styrene,block copolymers, styrene-etyhylene-butylene-styrene block copolymer and styrene-butadiene copolymer.

In order to obtain the required effect it was found necessary that the oil contained 0.3–7.0 weight% elastomer based on the weight of the oil. The upper limit is purely practical, as too much elastomer makes the oil viscous. 0.3 weight% elastomer is a minimum for obtaining increased stability of amount the HANFO explosive. The most preferred amount elastomer was found to be 4–6 weight%. Smaller amounts can be used for bulk products as they usually shall not be stored as long as cartridged products.

The new HANFO explosive can be manufactured by first adding 0.3–7.0 weight% of an oil-soluble elastomer having a viscosity average molecular weight of 30,000–5 million, based on the weight of the oil, to the oil of the ANFO-type explosive, whereupon this oil is mixed with sodium-, ammonium- and/or calcium nitrate. This mixture is then mixed together with a water-in-oil emulsion explosive.

The special features and scope of the invention are as defined in the attached claims.

The invention will now be further explained in connection with the examples, which show different ways of carrying out the invention, and the properties of the new explosive relative to known explosives.

During the experiments two different types of emulsions were applied, and in addition each emulsion was used in two modifications, i.e. one low refined and one high refined. Refining implies that the emulsion is treated in a colloid mill. The composition of these emulsions is stated in Table 1.

TABLE 1

| | Composition of the emulsions: | | | |
|---|---|---|---|---|
| EMULSION TYPE | A1 | A2 | B1 | B2 |
| Composition: | | | | |
| Nitrate solution | | | | |
| Amonium nitrate (1) (%) | 44 | 44 | 84 | 84 |
| Calcium nitrate (2) (%) | 44 | 44 | 0 | 0 |
| Water (%) | 12 | 12 | 16 | 16 |
| Hydrocarbon solution | | | | |
| Diesel oil (%) | 90 | 90 | 75 | 75 |
| Emulsifier (Span-80) (3) (%) | 10 | 10 | 25 | 25 |
| Mixture relations: | | | | |
| Nitrate solution (%) | 92 | 92 | 95 | 95 |
| Hydrocarbon solution (%) | 8 | 8 | 5 | 5 |
| Total composition: | | | | |
| Ammonium nitrate (%) | 42.9 | 42.9 | 79.8 | 79.8 |
| Calcium nitrate (calculated as $Ca(NO_3)_2$) (%) | 32.0 | 32.0 | 0.0 | 0.0 |
| Water (%) | 17.1 | 17.1 | 15.2 | 15.2 |
| Diesel oil (%) | 7.2 | 7.2 | 3.75 | 3.75 |
| Emulsifier (%) | 0.8 | 0.8 | 1.25 | 1.25 |
| Emulsion preparation: | | | | |
| Propeller mixer (rpm) | 1000 | 1000 | 1000 | 1000 |
| Colloid mill | No | Yes | No | Yes |
| Emulsifying temperature (°C.) | 70 | 70 | 90 | 90 |
| Viscosity | Low | Medium | Medium | High |

Comments:
(1): Crystalline ammonium nitrate
(2): CN-TQ from Norsk Hydro. This contains 79% calcium nitrate, 15% water of crystallizaton, 6% ammonium nitrate
(3): Span-80 is a registered trademark of ICI.

The emulsion mixtures were made by heating the components of the respective nitrate solution and hydrocarbon solution to the stated emulsifying temperature. The hydrocarbon mixture was then placed in an emulsifying vessel (volume about 6 l) and mixing was started. The nitrate solution was added within 60 seconds. The weight of the total mixture was about 5 kg. Those mixtures which should be refined were thereupon run through a colloid mill.

Use was made of porous ammonium nitrate (AN) from three different suppliers, I-III for the experiments. Date for these are stated in Table 2.

TABLE 2

| Manufacturer | I | II | III |
|---|---|---|---|
| Sieve analysis: | | | |
| +4.0 mm (%) | 0.0 | 0.0 | 0.0 |
| 4.0 mm–2.8 mm (%) | 0.2 | 0.2 | 0.2 |
| 2.8 mm–2.0 mm (%) | 14.4 | 36.8 | 14.9 |
| 2.0 mm–1.6 mm (%) | 62.6 | 55.3 | 68.4 |
| 1.6 mm–1.0 mm (%) | 20.0 | 7.6 | 12.8 |
| 1.0 mm–0.5 mm (%) | 2.3 | 0.1 | 3.0 |
| −0.5 mm (%) | 0.5 | 0.0 | 0.7 |
| Bulk density (kg/1) | 0.820 | 0.730 | 0.670 |
| Water content (%) | 0.10 | 0.15 | 0.10 |
| Oil absorbing capacity (%) | 7.0 | 7.5 | 11.0 |
| Stabilizer (%) | Boron Sulphur Phospher | None | Sulphate Aluminium |
| Conditioning agent (%) | 0.5 $SiO_2$ 0.6 Amine | 0.8 Talc 0.6 Sulphonate | 0.5 Talc |

Then HANFO mixtures were made from the previously mentioned components. The HANFO mixture according to the invention was made by first adding an elastomer to the oil and then mixing with ammonium nitrate, whereupon this mixture was added to an emulsion as stated in Table 1. The thereby formed HANFO mixture was then stored in buckets, and samples were taken out for testing and loaded in steel pipes for detonation testing.

EXAMPLE 1

This is a reference example based on a known technique. 12 tests were made for manufacture of HANFO mixtures in which elastomer was not added as stated according to the invention. Storage stability was measured, and in Table 3 is stated as storage time in days before hardening occurs. Mixing ratio HANFO:emulsion was 60:40 for all the tested HANFO explosives. The results of these tests are stated in Table 3.

TABLE 3

| Mixture relations: | 1 | 2 | 3 | 4 | 5 | 6 | 7 | 8 | 9 | 10 | 11 | 12 |
|---|---|---|---|---|---|---|---|---|---|---|---|---|
| ANFO | | | | | | | | | | | | |
| AN I (%) | 60 | 60 | 60 | 60 | | | | | | | | |
| AN II (%) | | | | | 60 | 60 | 60 | 60 | | | | |
| AN III (%) | | | | | | | | | 60 | 60 | 60 | 60 |
| Emulsion mixture: | | | | | | | | | | | | |
| A1 (%) | 40 | | | | 40 | | | | 40 | | | |
| A2 (%) | | 40 | | | | 40 | | | | 40 | | |
| B1 (%) | | | 40 | | | | 40 | | | | 40 | |
| B2 (%) | | | | 40 | | | | 40 | | | | 40 |
| Storage time before hardening (days) | 2 | 4 | 1 | 3 | 1 | 4 | 1 | 2 | 2 | 5 | 1 | 4 |

As can be seen from Table 3, all these mixtures have poor storage properties. This implies that they are not suitable for application in cartridged form and they also have a limited application. The reason for this is that by hardening sensitivity is lost and the water resistance is reduced drastically.

EXAMPLE 2

In this example the experiments were carried out according to the invention. Vistanex MML 120 polyisobutylene from the Exxon Corporation was used as elastomer. In all the mixtures use was made of diesel oil which before mixing with AN had added to it 5% Vistanex MML 120. The ANFO made consisted of 94 parts per weight of AN and 6 parts per weight oil-elastomer mixture. The composition and storage time before hardening for HANFO explosives according to the invention are stated in Table 4.

TABLE 4

| Mixture relations: | 13 | 14 | 15 | 16 | 17 | 18 | 19 | 20 | 21 | 22 | 23 | 24 |
|---|---|---|---|---|---|---|---|---|---|---|---|---|
| ANFO | | | | | | | | | | | | |
| AN I (%) | 60 | 60 | 60 | 60 | | | | | | | | |
| AN II (%) | | | | | 60 | 60 | 60 | 60 | | | | |
| AN III (%) | | | | | | | | | 60 | 60 | 60 | 60 |
| Emulsion mixture: | | | | | | | | | | | | |
| A1 (%) | 40 | | | | 40 | | | | 40 | | | |
| A2 (%) | | 40 | | | | 40 | | | | 40 | | |
| B1 (%) | | | 40 | | | | 40 | | | | 40 | |
| B2 (%) | | | | 40 | | | | 40 | | | | 40 |
| Amount Vistanex of total composition (%) | 0.17 | 0.17 | 0.17 | 0.17 | 0.17 | 0.17 | 0.17 | 0.17 | 0.17 | 0.17 | 0.17 | 0.17 |
| Storage time before hardening (days) | >60 | >60 | >60 | >60 | >60 | >60 | >60 | >60 | >60 | >60 | >60 | >60 |

As can be seen from Table 4, the HANFO mixtures according to the invention have substantially better storage properties than the previous HANFO explosives (Example 1). Even after 60 days of storage the explosives according to the invention were stable. In fact there has not so far been found any maximum storage time before hardening occurs. The storage properties are equally good for all the three types of AN, i.e. independent of the stabilizers added to AN. Therefore it seems that by using the invention also the negative effect related to the AN stabilizers is reduced.

EXAMPLE 4

Five experiments were also carried out for investigating the effect of varying molecular weights for the elastomers used. During these experiments use was made of different types of polyisobutylene. In all the experiments an ANFO was used in which the oil part consisted of 95% diesel oil and 5% Vistanex polyisobutylene having varying molecular weights. Average molecular weight varied from 990,000–2.1 million. Further, there was used porous ammonium nitrate from supplier I. The result of these experiments are stated in Table 5.

TABLE 5

| Mixture relations: | 25 | 26 | 27 | 28 | Average molecular weight* |
|---|---|---|---|---|---|
| ANFO (AN I) (%) | 60 | 60 | 60 | 60 | |
| Emulsion type | | | | | |
| A1 (%) | 40 | 40 | 40 | 40 | |
| Elastomer types: | | | | | |
| Vistanex MML 80 | 0.17 | | | | 990,000 |
| Vistanex MML100 | | 0.17 | | | 1.200,000 |
| Vistanex MML120 | | | 0.17 | | 1,600,000 |
| Vistanex MML140 (%) | | | | 0.17 | 2,100,000 |
| Detonation velocity: | | | | | |
| Newly made (m/s) | 3000 | 3100 | 3100 | 3100 | |
| After 60 days (m/s) | 3100 | 3100 | 3100 | 3100 | |

*Viscosity average molecular weight. Flory-standard according to supplier of Visyanex.

As can be seen from Table 5, the detonation velocity for all the HANFO explosives were the same for newly produced explosives as for corresponding explosives stored for 60 days. The effect of the elastomer within this storage time was independent of the molecular weight within the range tested in the example. However, it is likely that for long time storage there might be effects dependent on the molecular weight, probably increased storage stability with increasing molecular weight.

By manufacturing an explosive as stated above with addition of an elastomer of the ANFO component, the inventors were able to obtain an explosive by which one was free to choose the type of nitrate independent of its coating and/or stabilizing agents being used on these during the manufacture of HANFO explosive. Storage stable explosives were thereby obtained which maintained their initial detonation velocity even after more than 60 days of storage. These explosives could further be applied in cartridged form, which has made them far more applicable than previous HANFO explosives.

We claim:

1. A heavy ammonium nitrate fuel oil explosive comprising a mixture of at least one nitrate-oil explosive and at least one water-in-oil explosive, wherein the oil of the nitrate-oil explosive contains 0.3–7.0 weight %, based on the weight of said oil, of an oil-soluble elastomer having a viscosity average molecular weight of 30,000–5,000,000.

2. The explosive according to claim 1, wherein the oil of the nitrate-oil explosive contains 4–6 weight % of the elastomer, and the elastomer has a viscosity average molecular weight of 900,000–2,500,000.

3. A method for manufacturing the explosive as claimed in claim 1, which comprises mixing oil with 0.3–7.0 weight % of an oil-soluble elastomer having a viscosity average molecular weight of 30,000–5,000,000, based on the weight of the oil, mixing the resultant mixture with sodium-, ammonium- and/or calcium nitrate to form a nitrate-oil explosive, and mixing the nitrate-oil explosive with a water-in-oil emulsion explosive.

4. A method for manufacturing the explosive as claimed in claim 2, which comprises mixing oil with 0.3–7.0 weight % of an oil-soluble elastomer having a viscosity average molecular weight of 30,000–5,000,000, based on the weight of the oil, mixing the resultant mixture with sodium-, ammonium- and/or calcium nitrate to form a nitrate-oil explosive, and mixing the nitrate-oil explosive with a water-in-oil emulsion explosive.

* * * * *